US006152442A

United States Patent [19]

Nishinohara et al.

[11] Patent Number: 6,152,442

[45] Date of Patent: Nov. 28, 2000

[54] SHEET SEPARATING AND CONVEYING APPARATUS HAVING FRICTION RELEASING DEVICE TO SEPARATE CONVEY AND FRICTION MEANS

[75] Inventors: Takayuki Nishinohara, Toride; Atsushi Saito, Abiko; Fumihiko Nakamura, Tokyo; Daigo Nakagawa; Noriyuki Aoki, both of Toride, all of Japan

[73] Assignee: Canon Kabushiki Kaisha, Tokyo, Japan

[21] Appl. No.: 09/149,059

[22] Filed: Sep. 8, 1998

[30] Foreign Application Priority Data

| | | | |
|---|---|---|---|
| Sep. 12, 1997 | [JP] | Japan | 9-248256 |
| Sep. 30, 1997 | [JP] | Japan | 9-265790 |
| Sep. 30, 1997 | [JP] | Japan | 9-266112 |
| Sep. 30, 1997 | [JP] | Japan | 9-266113 |
| Dec. 12, 1997 | [JP] | Japan | 9-342673 |

[51] Int. Cl.[7] ..... B65H 3/52

[52] U.S. Cl. ..... 271/121; 271/124; 271/137; 271/273; 400/636.3

[58] Field of Search ..... 271/121, 124, 271/137, 138, 273; 400/636.3, 637.1

[56] References Cited

U.S. PATENT DOCUMENTS

| | | | |
|---|---|---|---|
| 924,460 | 6/1909 | Hess | 400/636.3 |
| 4,537,521 | 8/1985 | Rekewitz et al. | 400/636.3 X |
| 4,978,115 | 12/1990 | Sato et al. | 271/124 |
| 5,097,273 | 3/1992 | Moro et al. | 346/134 |
| 5,129,646 | 7/1992 | Miyakawa | 271/273 |
| 5,413,322 | 5/1995 | Torisawa et al. | 271/9 |
| 5,430,468 | 7/1995 | Sasai et al. | 346/136 |
| 5,510,909 | 4/1996 | Morikawa et al. | 358/498 |
| 5,718,424 | 2/1998 | Nakatani et al. | 271/121 |
| 5,772,343 | 6/1998 | Beretta et al. | 400/624 |

FOREIGN PATENT DOCUMENTS

| | | |
|---|---|---|
| 0 504 833 | 9/1992 | European Pat. Off. . |
| 0 686 590 | 12/1995 | European Pat. Off. . |
| 0 726 217 | 8/1996 | European Pat. Off. . |
| 59-013256 | 1/1984 | Japan . |

*Primary Examiner*—Christopher P. Ellis
*Assistant Examiner*—Richard Ridley
*Attorney, Agent, or Firm*—Fitzpatrick, Cella, Harper & Scinto

[57] ABSTRACT

The present invention provides a sheet separating and conveying apparatus for separating stacked sheets and for conveying a separated sheet, comprises a sheet convey means for conveying the sheet, a friction means disposed in a confronting relation to the sheet convey means, a biasing means for urging the sheet convey means and the friction means against each other, a preliminary convey means adapted to be urged against the sheet convey means at an upstream side of a contact position between the sheet convey means and the friction means in a sheet conveying direction, and a friction releasing means for separating the sheet convey means and the friction means from each other, and wherein, when the sheet convey means and the friction means are separated from each other by the friction releasing means, the preliminary convey means is maintained in a condition that the preliminary convey means is urged against the sheet convey means.

24 Claims, 16 Drawing Sheets

SHEET SEPARATING AND CONVEYING APPARATUS HAVING FRICTION RELEASING DEVICE TO SEPARATE CONVEY AND FRICTION MEANS

BACKGROUND OF THE INVENTION

1. Field of the Invention

The present invention relates to an image forming apparatus such as a facsimile, a printer and the like, and more particularly, it relates to an image forming apparatus in which an automatic sheet separating and conveying mechanism is improved.

2. Related Background Art

In many original reading portions of conventional image forming apparatuses (for example, an original reading portion of a facsimile), an automatic original separating and conveying mechanism for automatically separating originals one by one and for conveying the separated original is provided for permitting the setting of a plurality of originals for transmission. In many original separating and conveying mechanisms, a separation piece is contacted with a separation roller by urging the separation piece against the separation roller by means of an elastic member such as a spring.

In such a separating and conveying mechanism, the separation roller is rotated in an original conveying direction to separate a single sheet (paper sheet) contacted with the separation roller from the other paper sheets, by utilizing differences in a friction force between the paper sheets, a friction force between the paper sheet and the separation piece and a friction force between the paper sheet and the separation roller.

In the facsimile apparatus, various sheets such as thick paper sheets, thin paper sheets or sheets having weak stiffness may be used as originals. The friction force between the sheets, friction force between the separation roller and the sheet, and friction force between the separation piece and the sheet are greatly varied with temperature, humidity and/or sheet material.

Thus, in order to ensure that the originals can positively be separated even if such conditions are changed, there have been proposed a mechanism for adjusting the friction forces by changing a length of the elastic member for urging the separation piece in accordance with the kind of the sheet, and a mechanism for releasing the separation piece from the separation roller (for example, disclosed in Japanese Patent Application Laid-Open No. 59-13256).

In case of a multi-function facsimile having a color copying function or a function as a scanner connected to a computer and adapted to send a color image to the computer, as well as transmission and reception functions, a sheet different from a sheet used for transmission is used as an original.

For example, such an original may be a scrap of a newspaper, a color photograph, a color page of a magazine or a visiting card. The scraps of the newspaper and the magazine are formed from a thin paper sheet normally having both surfaces on which images are printed. When such a scrap (original) is conveyed, it is important that the original is not damaged and the rear surface of the original is not contaminated as well as the front surface.

In the conventional facsimile apparatuses, regarding the conveyance of the sheet, a function for positively separating an original bundle has been emphasized. To this end, the separation piece has been formed from rubber material having great coefficient of friction. As is in the conventional cases, even when the urging force is weakened, since the coefficient of friction of the separation piece is great, there is a danger of damaging or scratching the original. Due to rubbing between the original and the rubber material used in the separation piece, a rubber mark (rubber powder) of the separation piece is adhered to the rear surface of the original. On the other hand, when a thick and hard sheet such as a visiting card is used as the original, it is difficult to convey the sheet only when the urging force is weakened.

In consideration of the above, in order to ensure that the thick sheet (such as a visiting card) is positively conveyed, a photograph and a newspaper are conveyed without damage and without adhering the rubber mark onto the rear surface, a mechanism for completely separating the separation piece from the separation roller is required.

In the conventional techniques, a purpose for releasing the separation piece was that the original which was damaged during the conveyance is removed. Thus, in an arrangement, at the same time when the separation piece is released, an auxiliary convey portion is also separated. Accordingly, when such an arrangement is applied to the original conveyance, a tip end of the original must be inserted up to a reading position (located at a deeper portion of the apparatus).

The visiting card has a feature that not only it is thick but also it has a small size. It is difficult to set the visiting card without any bending during the insertion of the card. Further, when the visiting card is inserted, since the conveyance of the card from a sheet insertion opening is effected only by the separation roller, it is difficult to achieve stable conveyance (a tip end of the card is apt to be skew fed).

SUMMARY OF THE INVENTION

An object of the present invention is to achieve conveyance of a single original without generating scratch and contamination on a rear surface of the original in a sheet separating and conveying apparatus having a friction separating system.

Another object of the present invention is to achieve setting and stable conveyance of an original as a thick sheet and an original having a visiting card size.

To achieve the above objects, according to the present invention, there is provided a sheet separating and conveying apparatus comprising a sheet convey means for conveying a sheet, a friction means disposed to oppose to the sheet convey means, a biasing means for effecting abutment between the sheet convey means and the friction means, an auxiliary convey means for abutting against the sheet convey means at a position located at an upstream side of an abutment position between the sheet convey means and the friction means in a sheet conveying direction, and a friction releasing means for effecting separation between the sheet convey means and the friction means, wherein, when the sheet convey means and the friction means are separated from each other by the friction releasing means, the auxiliary convey means is maintained in a condition that the auxiliary convey means abuts against the sheet convey means.

DETAILED DESCRIPTION OF THE PREFERRED EMBODIMENTS

The present invention will now be explained in connection with preferred embodiments thereof with reference to the accompanying drawings.

Figure 1:
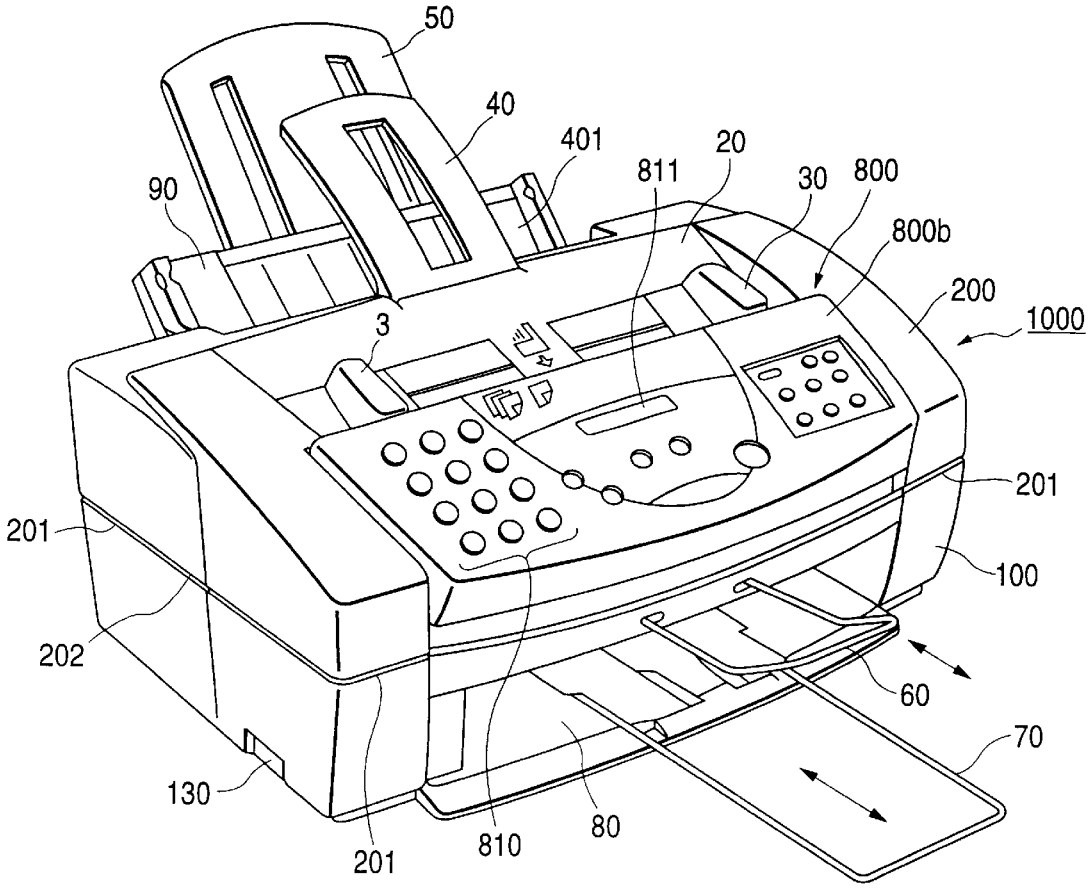
FIG. 1 is a perspective view of a facsimile apparatus as an image forming apparatus according to the present invention.

FIG. 1 is a perspective view of a facsimile apparatus as an image forming apparatus.

In FIG. 1, a color reading facsimile apparatus 1000 as a reading and recording apparatus has a frame constituting front, rear, left and right side walls, as shown, within which a color scanner apparatus 800 as an original conveying type color reading apparatus, a serial recording apparatus as a recording apparatus, a color control substrate, and a power source are housed. These elements are formed independently so that they can easily be exchanged.

The frame is essentially constituted by a lower cover (first or lower frame) 100, an upper cover (second or upper frame) 200, and a rear cover (third frame) (described later) for guiding a recording sheet and for covering the power source.

An original support 20 provided with width-adjustable sliders 30 for guiding the original in a width-wise direction (which sliders can be shifted toward and away from the center of the original support by moving only one of the sliders) is supported for rocking movement with respect to the upper cover 200, which will be described later, so as to permit access to an ink head.

An original stacking tray 40 which can detachably mounted is provided behind the original support 20 so that, for example, when an original having A4 size is conveyed forwardly toward the color scanner portion 800, a tail end portion of the original is prevented from being suspended.

Further, the original with an imaged surface facing downwardly is conveyed from below the color scanner portion 800 to a front portion of the apparatus 1000 to be rested on an original discharge tray 60. The original discharge tray 60 can be shifted in a front-and-rear direction of the apparatus 1000 as shown by the double-headed arrow.

On the other hand, after a width-wise position of a recording sheet conveyed to the recording apparatus is regulated by shifting a width adjusting plate 90 provided on a recording sheet support 401 which is located on the back side of the apparatus 1000, serial recording is effected regarding the recording sheet at a printer portion which will be described later, and then, the recording sheet is discharged onto a recording sheet discharge tray 80 disposed below the color scanner portion 800.

When the recording sheet is conveyed in such a manner that a longitudinal length of the recording sheet is oriented to the front-and-rear direction of the apparatus, a rear recording sheet support plate 50 and a front recording sheet support rod 70 are provided for preventing suspension of the recording sheet. The support plate 50 is incorporated into the recording sheet support 401 so that it can be drawn to a position as shown, and the front recording sheet support rod 70 can also be drawn in the front-and-rear direction, as well as the original discharge tray or original support rod 60.

Further, as shown, the upper cover 200 has a shape surrounding the color scanner portion 800, and, by removing the upper cover from the lower cover 100 along an edge 202 of the upper cover 200, the color scanner portion 800 can be remained on the lower cover 100.

A scanner body portion 800*a* and a panel portion 800*b* are connected to the color scanner portion 800 for opening/closing movement around their hinges (not shown). A liquid crystal display portion 811, dial keys 810 and other operation portions are arranged on the panel portion 800*b* as shown.

Figure 2:
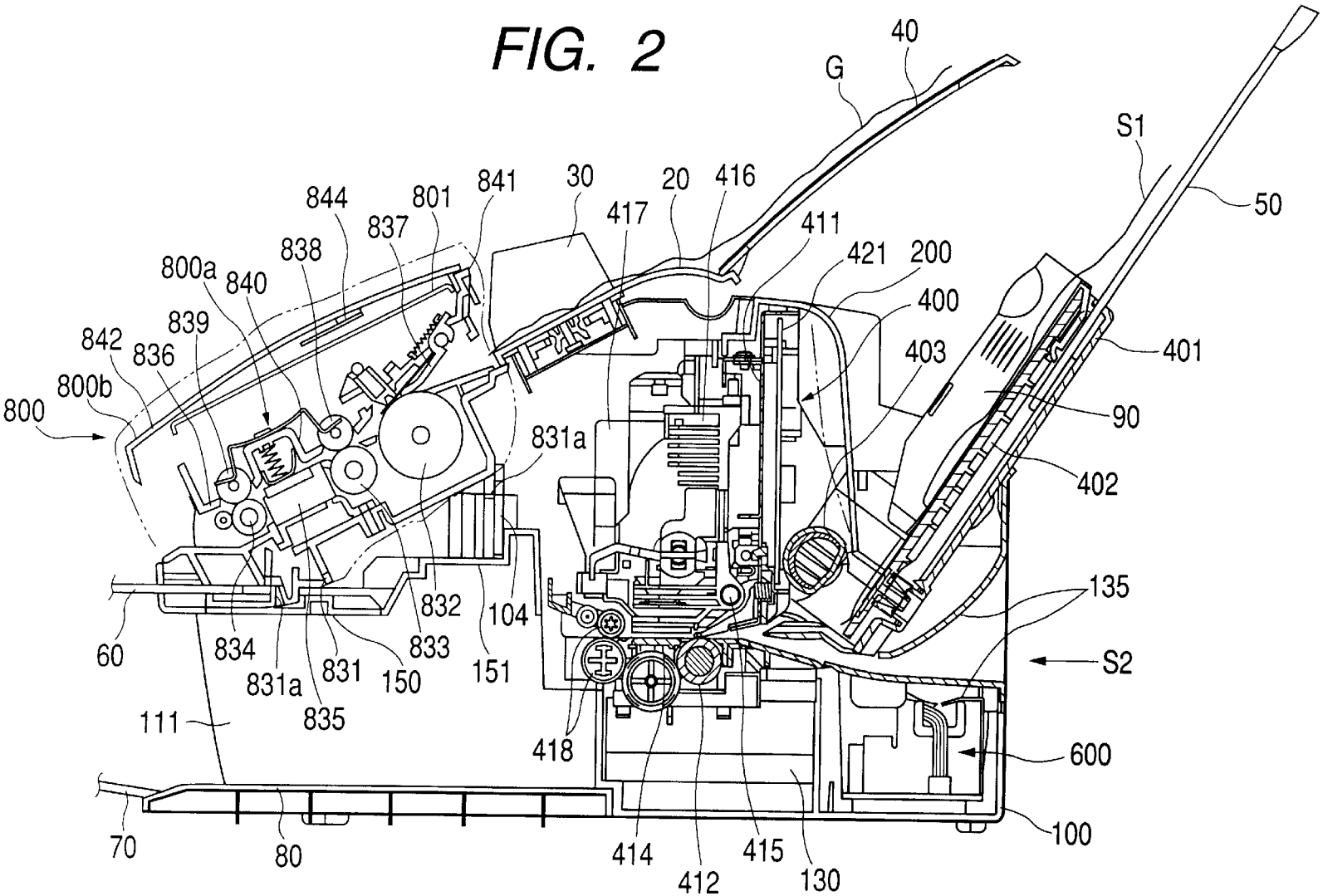
FIG. 2 is a sectional side view of the image forming apparatus shown in FIG. 1.

FIG. 2 is a side sectional view of the apparatus 100, with the upper cover 200 omitted from illustration. In FIG. 2, the same elements as those already explained are designated by the same reference numerals and explanation thereof will be omitted. Within the lower cover 100 with which a base portion (defining a bottom surface), side walls (defining an outer surfaces) and an opening surface enclosed by the side walls are integrally formed, (a) the color scanner portion 800 as the original conveying type reading apparatus for reading the original while conveying the original, (b) a printer 400 as the serial recording apparatus for effecting serial recording while conveying the recording sheet, (c) the color control substrate and power source 600 connected to the color scanner portion and the printer to effect predetermined control, (d) an ink absorbing body 130 for absorbing waste ink during initial ink discharging, (e) a rear cover 135 and (f) the recording sheet support or discharge tray 80 can be secured to the lower cover 100 without using any tool.

Next, carious elements will be explained with reference to FIGS. 2 and 3. First of all, the color scanner portion 800 will be described.

In the color scanner portion 800, light reflected from the original G is converted into an electric signal, and the converted electric signal is sent to other machines or the printer portion 400 in accordance with operation modes. The originals are stacked on the original support 20.

The color scanner portion 800 is provided with a scanner base 831 for constituting a frame of the color scanner portion 800 and for guiding a lower side of the original G, which scanner base is secured to the lower cover 100. On the scanner base 831, there are provided a separation roller 832 for feeding out the original, a supply roller 833 for conveying the original, discharge roller 834 for discharging the original onto the original discharge tray, and a color contact sensor 835 for reading image information on the original.

The panel portion 800*b* is rotatably attached to the scanner base 831 by a fulcrum (not shown) and includes an upper original guide 836 for guiding an upper side of the original, a separation piece (friction means) 837 opposed to and urged against the separation roller (sheet convey means) 832, a supply sub-roller 838 opposed to and urged against the sheet supply roller 833, a discharge sub-roller 839 opposed to and urged against the discharge roller 834, a reading white board (reading white reference) 840 opposed to an urged against the color contact sensor 835, and a release lever 841 for releasing the separation piece 837 to convey a thick original.

A panel frame 842 forms a part of an outer wall and is attached to the upper original guide. On the panel frame 842, there are provided operation keys 843, a display portion such as LCD, and a panel substrate 845 on which the keys and the display portion are mounted.

The original conveyance and the reading operation in the color scanner portion 800 are effected by motors and sensor drive circuits (both are not shown), and the control and display control of the panel portion 801 are effected by the color control substrate.

Next, the printer 400 will be explained. In the printer portion 400, a tray (stacking means) 402 of a sheet supply portion is disposed on the base 401 and has an intermediate plate supported by a fulcrum (not shown), which intermediate plate is biased by a spring. The base 401 is secured to the printer body portion 400 by screws.

The recording sheets S1 are stacked on the intermediate plate. A lower surface of the recording sheet stack is supported by a sheet supply tray provided on a sheet supply base in an expansion and contraction manner, and a lateral position of the sheet stack is regulated by the side guide 90 movably provided on the intermediate plate. A sheet supply roller 403 serves to feed out the recording sheets one by one and to send the recording sheet to the printer portion 400. A manually inserted recording sheet supplied from the rear cover is designated by "S2".

The printer body portion 400 is provided with an ink jet recording portion, for example. An ink jet head 417 serves to record an ink image on the sheet S conveyed by a convey roller 412 and a pinch roller. As a recording means in this apparatus, an ink jet recording system for effecting the recording by discharging ink from the ink head may be used. That is to say, the ink head has fine liquid discharge openings (orifices), liquid passages, energy acting portions provided in the respective liquid passages, and energy generating means for generating liquid droplet forming energy to be applied to the liquid on the acting portion.

As recording methods utilizing energy generating means for generating such energy, there has been proposed a recording means using electrical/mechanical converters such as piezo-electric elements, a recording method using energy generating means for discharging a liquid droplet by the action of heat generated by applying an electromagnetic wave such as laser, and a recording method using energy generating means for discharging a liquid droplet by an electrical/thermal converter such as a heat generating element having a heat generating resistance body.

Among them, an ink head used in the ink jet recording method for discharging the liquid by the thermal energy can effect the recording with a high resolving power since liquid discharge openings (orifices) for forming discharge liquid droplets by discharging recording liquid droplets can be arranged with high density. Among them, an ink head using the electrical/thermal converters as the energy generating means can easily be made compact, can fully utilize merits of IC techniques and micro working techniques which have been progressed remarkably in a recent semi-conductor field and in which reliability has improved remarkably, can be mounted with high density and can be manufactured cheaply.

The printer body portion 400 has a printer chassis (frame) 411 secured to the lower cover 100. A sheet feed roller 412 and a pinch roller urged against the sheet feed roller serve to feed the recording sheet S supplied from the sheet supply portion toward a downstream printing portion.

In the printing portion, a platen 414 serves to support a lower or rear surface of the recording sheet, and an image is recorded on a upper or front surface of the recording sheet by an ink head 417 attached to a carriage 416 reciprocally mounted on a guide shaft 415.

Thereafter, the recording sheet S is discharged out of the printer portion 400 by a pair of recording sheet discharge rollers 418 and is rested on the recording sheet support or discharge tray 80 provided on the lower cover 100.

The conveyance of the recording sheet and the recording operation in the printer portion 400 are effected by using motors, sensors and a head drive circuit (all of them are not shown) which are controlled by the control substrate portion. Further, there is provided a recording interruption substrate 421 for relaying from signals from the motors, the sensors and the head drive circuit and for transferring the signals to the control substrate portion. The ink absorbing body 130 for absorbing waste ink generated during an operation for preventing ink clogging in the printer portion 400 is attached to the lower cover 100.

Next, a flow of the original G will be explained. FIG. 3 is an enlarged sectional view of the color scanner portion 800. An original convey path is as shown by the arrow F. In FIG. 2, the originals G are stacked on the original stacking tray 40 with imaged surfaces thereof facing downwardly. The originals G stacked on the original stacking tray 40 are positioned by the sliders 30 shiftable in the width-wise direction.

An auxiliary convey arm 906 is opposed to the separation roller 832 and is urged against the separation roller 832 by an auxiliary convey spring 904 which will be described later. The stacked original sheets are preliminarily conveyed toward the nip between the separation roller 832 and the separation piece 837 (described later) by the cooperation of the auxiliary convey arm with the separation roller.

The separation piece 837 is urged against the separation roller 832 from the above by means of a separation spring 903, and the preliminarily conveyed originals G are separated one by one from a lowermost one by the cooperation of the separation piece 837 with the separation roller 832. Further, the separation roller 832 also serves to convey the separated original to the sheet supply roller 833.

The original G conveyed by the separation roller 832 is conveyed to a reading position of the contact color sensor 835 by means of the sheet supply roller 333. The contact color sensor 835 reads the image on the original G conveyed by the sheet supply roller. The reading white board 840 is biased along a reading line of the contact color sensor 835 from the above by a white board spring 907 so as to closely contact the image of the original G with the reading line.

The original G which was conveyed and read is discharged by the discharge roller 834. The discharged original G is rested on the original discharge tray 60 which is detachably mounted on a body of the apparatus.

Next, a sheet separation and convey portion D will be explained. FIG. 4 is an enlarged perspective view of the sheet separation and convey portion shown by the circle D in FIG. 3. In the illustrated embodiment, a separation piece releasing mechanism for releasing the urging of the separation piece and for holding the releasing condition will be fully described.

In FIG. 4, the original sheets are set in an original insertion opening defined between the upper original guide 836 and a lower original guide 901.

Figure 3:
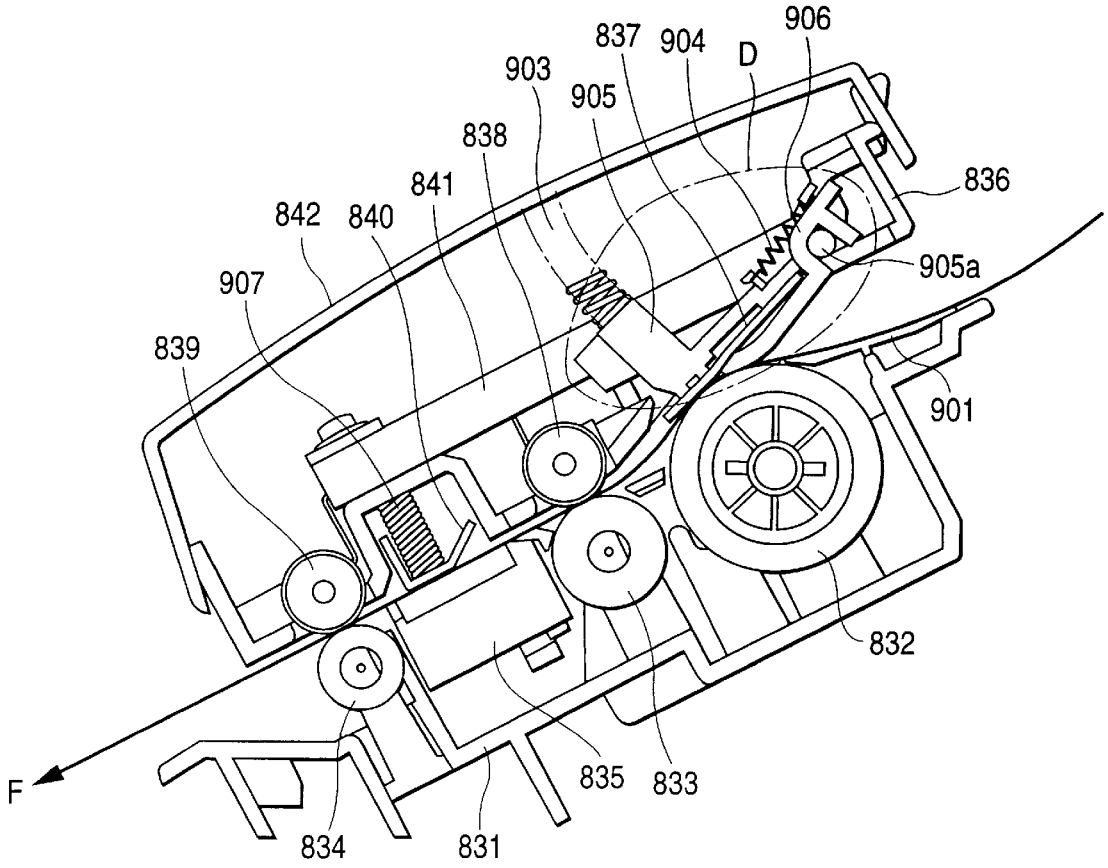
FIG. 3 is an enlarged sectional side view of a sheet convey portion of the image forming apparatus shown in FIG. 1.
Figure 4:
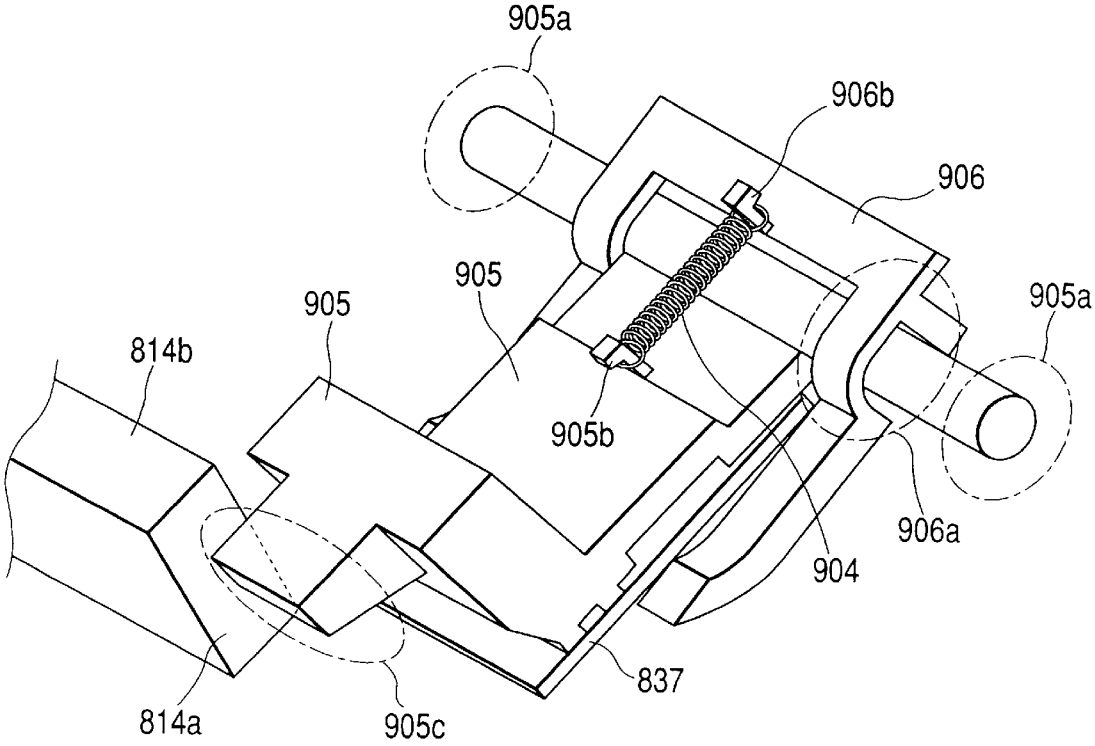
FIG. 4 is a perspective view of a separation piece releasing mechanism of the image forming apparatus shown in FIG. 1.

In FIGS. 3 and 4, the separation piece 837 formed from a friction material such as rubber is attached to a holder 905. The auxiliary convey arm 906 is formed from plastic, metal plate or rubber having relatively small coefficient of friction. A projection shaft 905*a* extends from the holder 905.

The auxiliary convey arm 906 is provided with a concave portion 906*a*, and the projection shaft 905*a* of the holder 905 is received in a recess of the concave portion 906*a*. The auxiliary convey arm 906 can be rotated around the projection 905*a*.

The preliminary convey spring (auxiliary convey arm biasing means) 904 is a tension coil spring having one end attached to a projection 906*a* of the auxiliary convey arm 906 and the other end attached to the projection shaft 905*a* of the holder 905.

The upper original guide 836 is provided with a concave portion (not shown) and the projection shaft 905*a* of the holder 905 is received in a recess of such a concave portion. The holder 905 can be rotated around the projection shaft 905*a*. The holder 905 is opposed to the separation roller 832 so that the auxiliary convey arm 906 and the separation piece 837 are contacted with the separation roller 832.

One end of the separation spring (holder biasing means) 903 is engaged by a receiving surface 905*b* of the holder 905, and the other end is engaged by the operation panel 842. The separation spring 903 is a compression coil spring. The separation piece 837 on the holder 905 is urged against the separation roller 832 by an elastic force of the spring.

Since the elastic force of the separation spring 903 is greater than a pulling force of the preliminary convey spring 904, the auxiliary convey arm 906 is urged against the separation roller 832 by the action of the separation spring 903 and the preliminary convey spring 904.

The release lever 841 acting as a friction releasing means for releasing the separation piece is a member for creating a gap between the separation piece 837 and the separation roller 832 and for maintaining the gap. In FIG. 4, the release lever 841 is provided with an inclined portion or taper portion 841*a* for separating the separation piece 837 from the separation roller 832, a flat portion 841*b* for maintaining the release lever in a separation condition, and an operation portion 841*c* (FIGS. 5A and 5B).

Figure 5A:
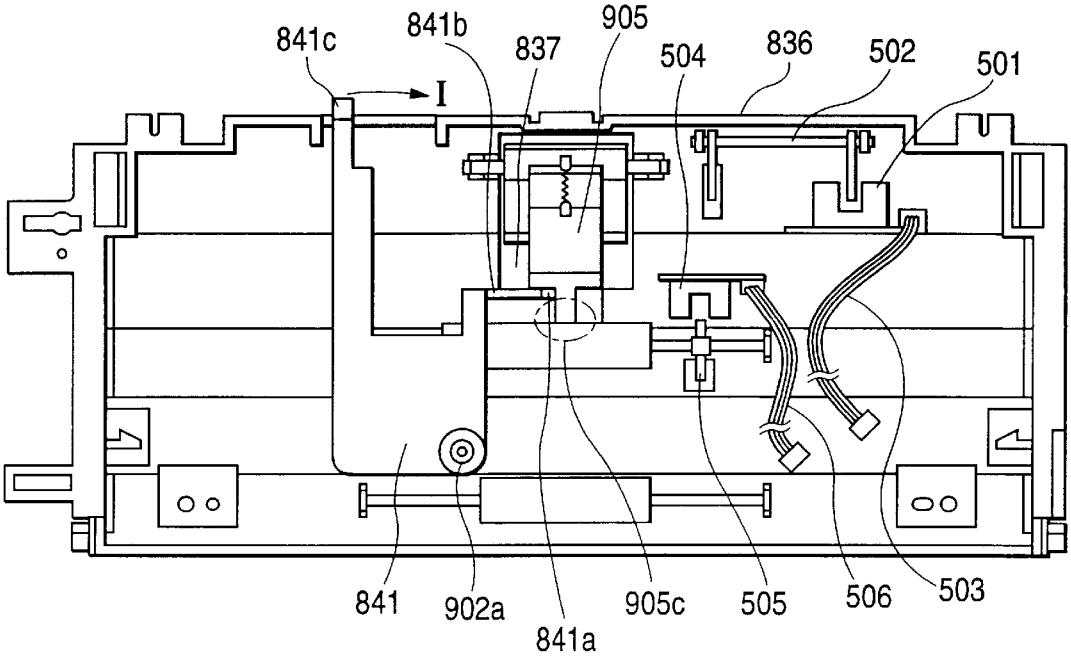
FIG. 5A is a plan view showing arrangement on an upper guide of the separation piece releasing mechanism in a normal condition.
Figure 5B:
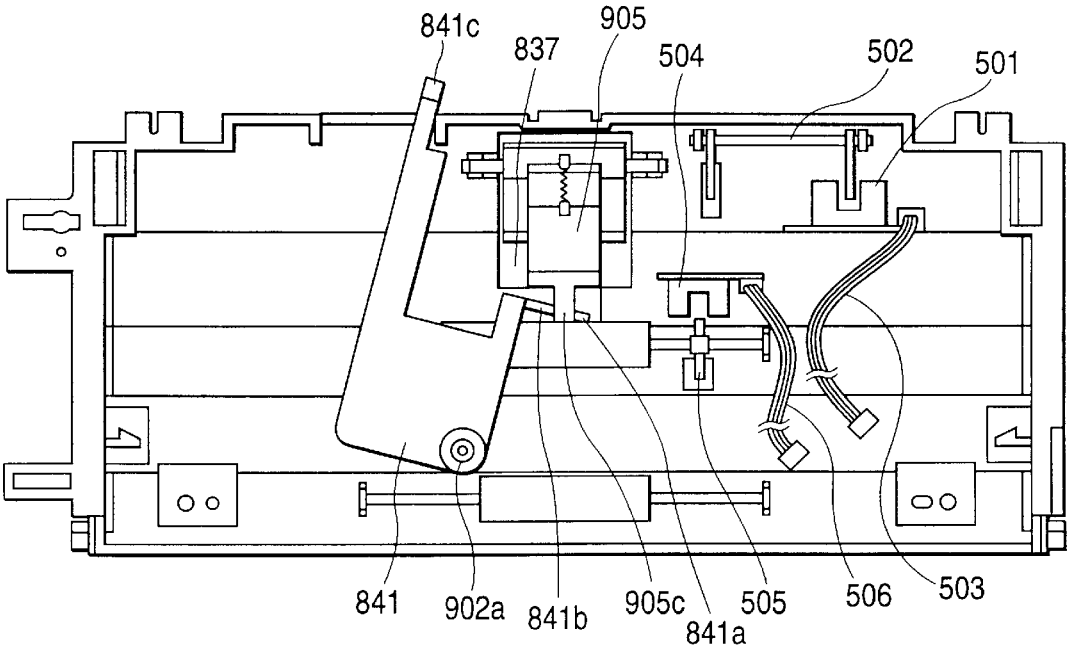
FIG. 5B is a plan view showing the arrangement on the upper guide of the separation piece releasing mechanism in a condition that the separation piece is released.

FIG. 5A shows a condition that the holder 905 and the release lever 841 are incorporated onto the upper original guide. The release lever 841 is attached to a shaft 902*a* substantially perpendicular to a sheet convey surface of an upper guide of the body of the apparatus so that the release lever 841 can be rotated around the shaft 902*a* to be shifted substantially in parallel with the sheet convey surface by manipulating the operation portion 841*c*. The operation portion 841*c* of the release lever 841 is exposed to outside through the panel portion 800*b* more greater after the friction releasing operation than before the friction releasing operation. The release lever 841 may be shifted substantially in parallel with the sheet convey surface by sliding movement rather than the rotational movement. By manipulating the separation piece release lever 841 in the rotational direction, the taper portion on the tip end of the release lever 841 pushes an engagement projection 905*c* of the holder 905 upwardly. The taper portion may be formed on the projection 905*c* of the holder 905.

As shown in FIG. 5A, the release lever 841 is disposed, with respect to the separation piece 837 positioned at a central portion of a main scanning direction of the original sheet insertion opening M, at a side opposite to a side where a DS sensor 501 for detecting the presence/absence of the original, a DC actuator 502, a DES sensor for detecting a tip and/or tail end of the original and a DES actuator 505 are disposed. For example, the sensors 501, 504 are photo-sensors which are operated by photo-interrupter of the actuators (which are shifted by engaging with the sheet) to generate signals.

With this arrangement, even when the release lever 841 is operated, the lever is not contacted with the sensors, sensor actuators and cables 503, 506 from the sensors, thereby preventing the latter from damaging.

Now, the operation of the separation piece releasing mechanism will be described with reference to FIGS. 5A, 5B and 6. In FIG. 5A, when the release lever 841 is operated in a direction shown by the arrow I, the inclined portion 841*a* on the tip end of the release lever 841 abuts against the projection 905*c* of the holder. When the release lever is further operated in the direction I, the projection 905*c* of the holder is pushed upwardly by the inclined portion 841*a* on the tip end of the release lever, with the result that the holder 905 is rotated upwardly around the shaft 905*a*. When the projection 905*c* of the holder 905 reaches the flat portion 841*b* on the tip end of the release lever 841, the projection 905*c* of the holder 905 is held in a lifted condition. This condition is shown in FIG. 5B.

Figure 6:
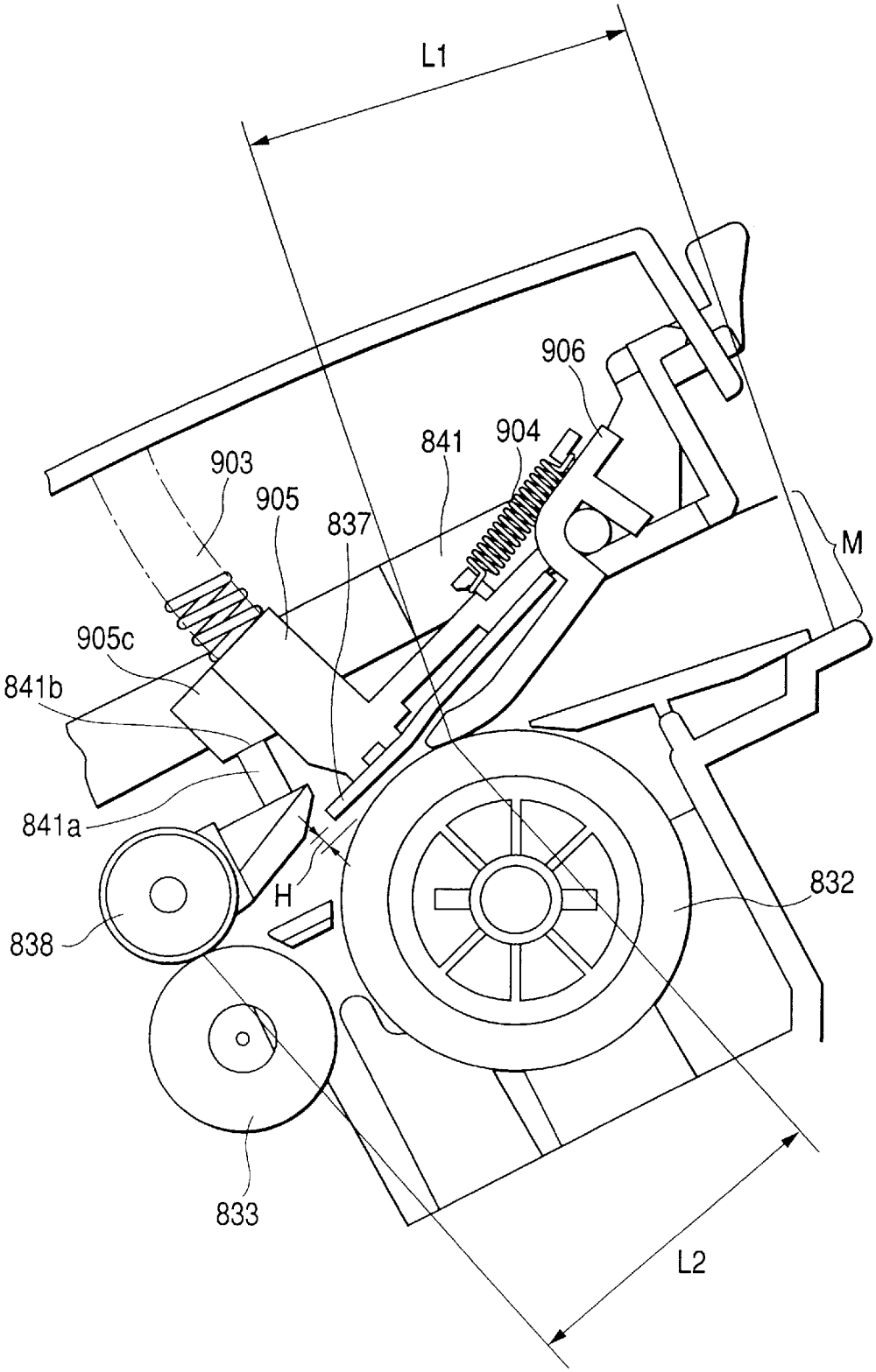
FIG. 6 is an enlarged sectional side view of a sheet convey portion in the condition that the separation piece is released.

FIG. 6 is a sectional view showing a condition that the tip end of the holder 905 is held in the lifted position by manipulating the release lever 841. A gap H is formed between the separation piece 837 and the separation roller 832 by manipulating the release lever in a direction shown by the arrow in FIG. 5A.

When the projection 905*c* of the holder 905 is lifted, although the elongation of the preliminary convey spring (elastic tension spring) 904 attached to the holder 905 and the auxiliary convey arm 906 becomes small, since the force of the separation spring 903 for urging the holder 905 is strong, the auxiliary convey arm 906 is urged against the separation roller 832 by the elastic force of the preliminary convey spring 904. Accordingly, when the release lever 841 is manipulated, the auxiliary convey arm 906 is maintained to be urged against the separation roller. The urging position of the auxiliary convey arm 906 is the same as the position when the separation piece 837 is not separated.

The flow of the original obtained when the separation piece 837 is released from the separation roller 832 by manipulating the release lever 841 will now be described. The original G are set on the original stacking tray 4. The tip ends of the originals G are set at a position where the auxiliary convey arm 906 is contacted with the separation roller 832. This position is the same as the position when the separation piece 837 is not released. Thus, the operator does not required to change the position where the originals are set. The stacked originals G are conveyed to the sheet supply roller 833 by the rotation of the separation roller 832.

Since the friction force does not act between the separation piece 837 and the original G, although the separation ability for separating the plurality of sheets is decreased, a single thick sheet can be conveyed. In addition, it can be prevented that the rubber mark of the separation piece 837 is formed on the rear surface of the original and that the scratch (due to the friction between the separation piece 837 and the original) is formed on the original.

Until the tip end of the original G is pinched between the sheet supply roller 833 and the supply sub-roller 838, the original G is stably conveyed in the condition that the original is urged against the separation roller 832 by the auxiliary convey arm 906. If there is no urging of the auxiliary convey arm 906 and the original G is conveyed by the rotation of the separation roller 832, the original is conveyed only by the friction force between the separation roller 832 and the original G due to the weight of the original itself. In this case, the conveying force is small, conveyance of the original G becomes unstable and the tip end of the original is apt to be skewed.

Next, a positional relation between the separation roller 832, sheet supply roller 833, separation piece 837 and auxiliary convey arm 906 will be explained. In FIG. 6, "L2" is a distance from a contact position between the sheet supply roller 833 and the sheet supply sub-roller 838 to a contact position between the separation roller 832 and the auxiliary convey arm 906, and "L1" is a distance from the contact position between the separation roller 832 and the auxiliary convey arm 906 to the sheet insertion opening M.

The sheet insertion opening M is defined by the upper original guide and the lower original guide. The position of the sheet insertion opening can be seen by the operator from the outside of the body of the apparatus. In the illustrated embodiment, L1 and L2 are selected to 30 mm or in consideration of the visiting card.

When the originals are set, the tip ends of the originals abut against the contact position between the auxiliary convey arm 906 and the separation roller 832. The visiting card has a dimension of about 80 mm×40 mm. After the separation piece 837 is released, when the visiting cards are set, since L1 is 30mm, the tail ends (of about 10mm) of the visiting cards protrude from the sheet insertion opening (which tail portions can be seen by the operator). Thus, even if the visiting cards are erroneously set obliquely, the operator can correct the erroneous insertion of the visiting cards.

Further, since the distance 12 through which the original is advanced before the original is pinched between the sheet supply roller 833 and the sheet supply sub-roller 838 and the original supply is started is smaller than the size of the visiting card, the visiting card is maintained in a condition that the card is urged against the auxiliary convey arm 906 until the tip end of the visiting card is pinched by the sheet supply roller. Thus, the visiting card can be conveyed stably.

According to the above-mentioned embodiment, the separation piece (friction means) 837 and the holder 905 disposed to be contacted with the separation roller (convey means) 832 are separated or released from the separation roller by manipulating the release lever (friction releasing means) 841. In this case, the auxiliary convey arm (preliminary convey means) 906 can be maintained in the condition that is urged against the separation roller 832. Further, since the operation portion of the release lever 841 is exposed outside of the apparatus such as the panel frame 842, the operator can easily handle the release lever 841.

Therefore, when the original is conveyed in the condition that the separation piece 837 is released by manipulating the release lever 841, the rubber power or contamination is not adhered to the rear surface of the original and the original is not damaged during the conveyance thereof, with the result that the photograph or the scrap of the newspaper can be used as the original. Further, by releasing the separation piece 837, the thick sheet can be used as the original.

Since the auxiliary convey arm 906 is not released from the separation roller 832, the set position of the tip end of the original stack when the separation piece 837 is released is the same as the normal set position of the tip end of the original stack, with the result that, when the small size sheets such as the visiting cards are set in the condition that the separation piece 837 is released, the tail ends of the sheets protrude from the sheet insertion opening so that the sheets can be seen by the operator. Thus, the sheets can be re-set to correct the skew-setting. Further, during the sheet conveyance, since the visiting card is urged against the auxiliary convey arm 906 until the visiting card is pinched between the sheet supply roller 833 and the sheet supply sub-roller 838, the visiting card is conveyed stably. Thus, the thick sheet having small size such as the visiting card can be conveyed stably. The above-mentioned advantages are remarkable particularly when the sheet separating and conveying apparatus is used in a facsimile.

Figure 7:
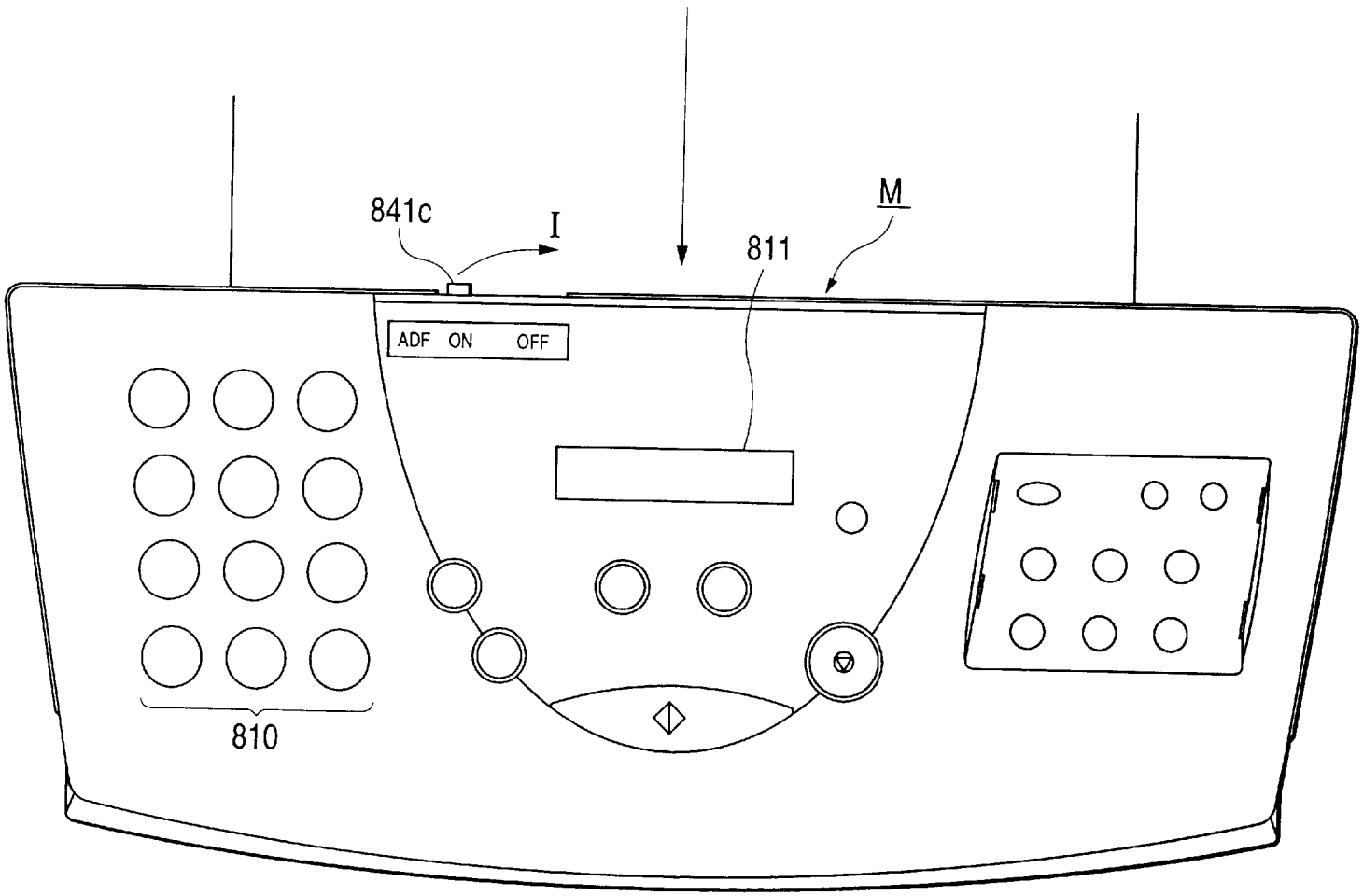
FIG. 7 is a view showing a position of a release lever in a condition that a friction means is urged against a sheet convey means, looked at from an operation panel side.

Next, the appearance of the release lever 841 when the separation piece 837 is released will be fully explained with reference to FIGS. 7 and 8. FIG. 7 shows the normal condition that the separation piece 837 is urged against the separation roller 832. In this case, the portion of the operation portion 841*c* of the release lever 841 which protrudes out of the apparatus is very small so that the protruded portion can be observed by the operator slightly.

Figure 8:
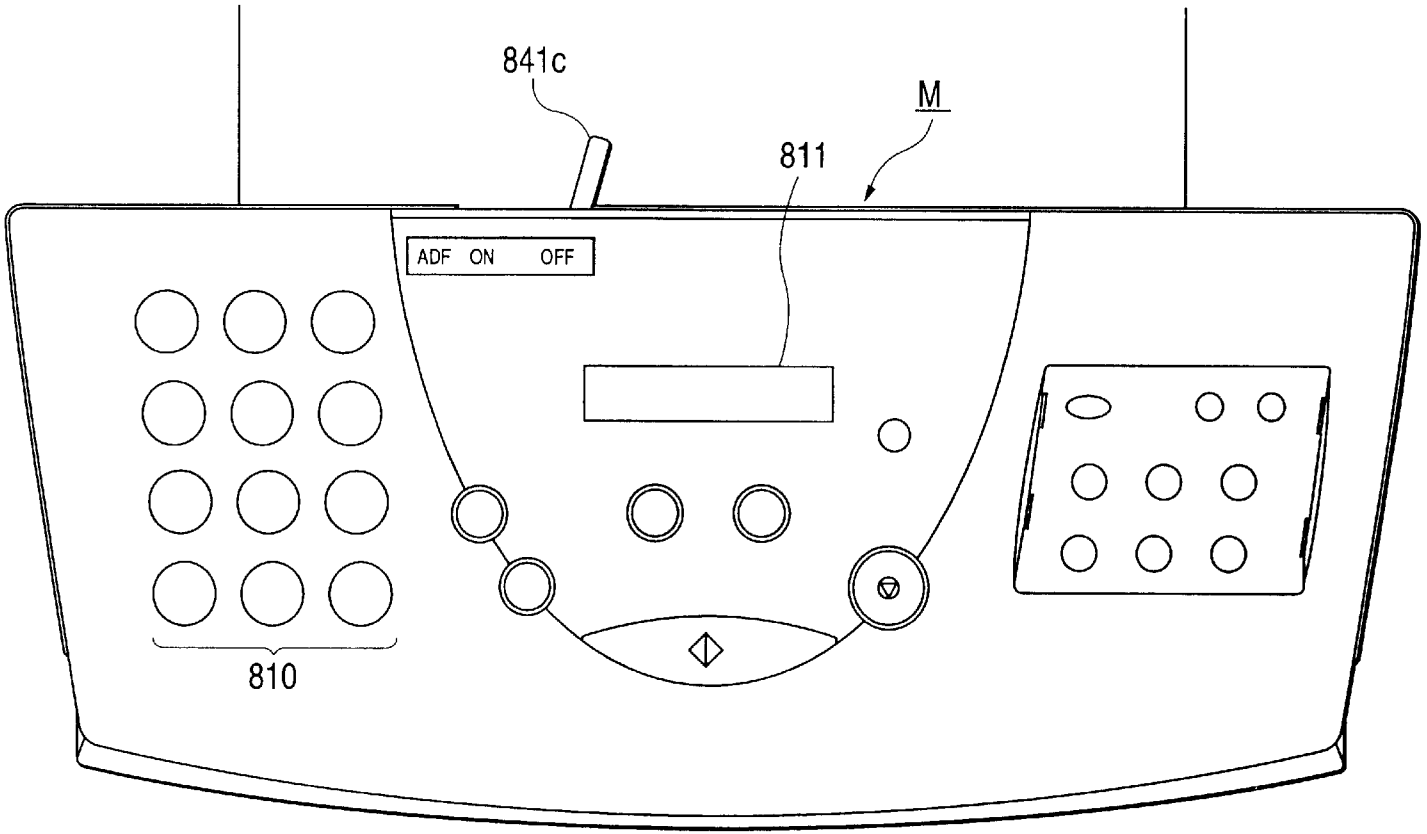
FIG. 8 is a view showing the position of the release lever in a condition that the friction means is released, looked at from the operation panel side.

When the separation piece 837 is separated from the separation roller 832 by manipulating the operation portion 841*c* of the release lever 841 in the direction I in FIG. 7 from the condition shown in FIG. 7, the operation portion 831*c* is protruded from the center of the original insertion opening M (refer to FIG. 8).

As shown in FIG. 8, in the condition that the separation piece 837 is released, since the operation portion 841*c* is protruded from the center of the original insertion opening M, when the operator tries to insert the original stack (bundle) G into the original insertion opening M to set the original stack, from the appearance (condition that the operation portion 841*c* is protruded), the fact that the separation piece 837 is separated or released from the separation roller 832 can easily be ascertained. Thus, the erroneous operation in which a plurality of originals G are set in the condition that the separation piece 837 is separated or released from the separation roller 832 can be prevented.

As mentioned above, by rotating the release lever 841 by manipulating the operation portion 841*c* from the outside of the apparatus without disassembling the apparatus, the separation piece 837 can be separated or released from the separation roller 832, and, the operator can easily ascertain the present urging condition of the separation piece 837 from the appearance.

Further, since the operation portion (manipulating means) 841*c*, and the inclined portion 841*a* and the flat portion 841*b*

(friction releasing means) are formed on the single member, i.e., release lever 841, the number of parts can be reduced and the construction can be simplified, thereby reducing the cost.

Figure 9:
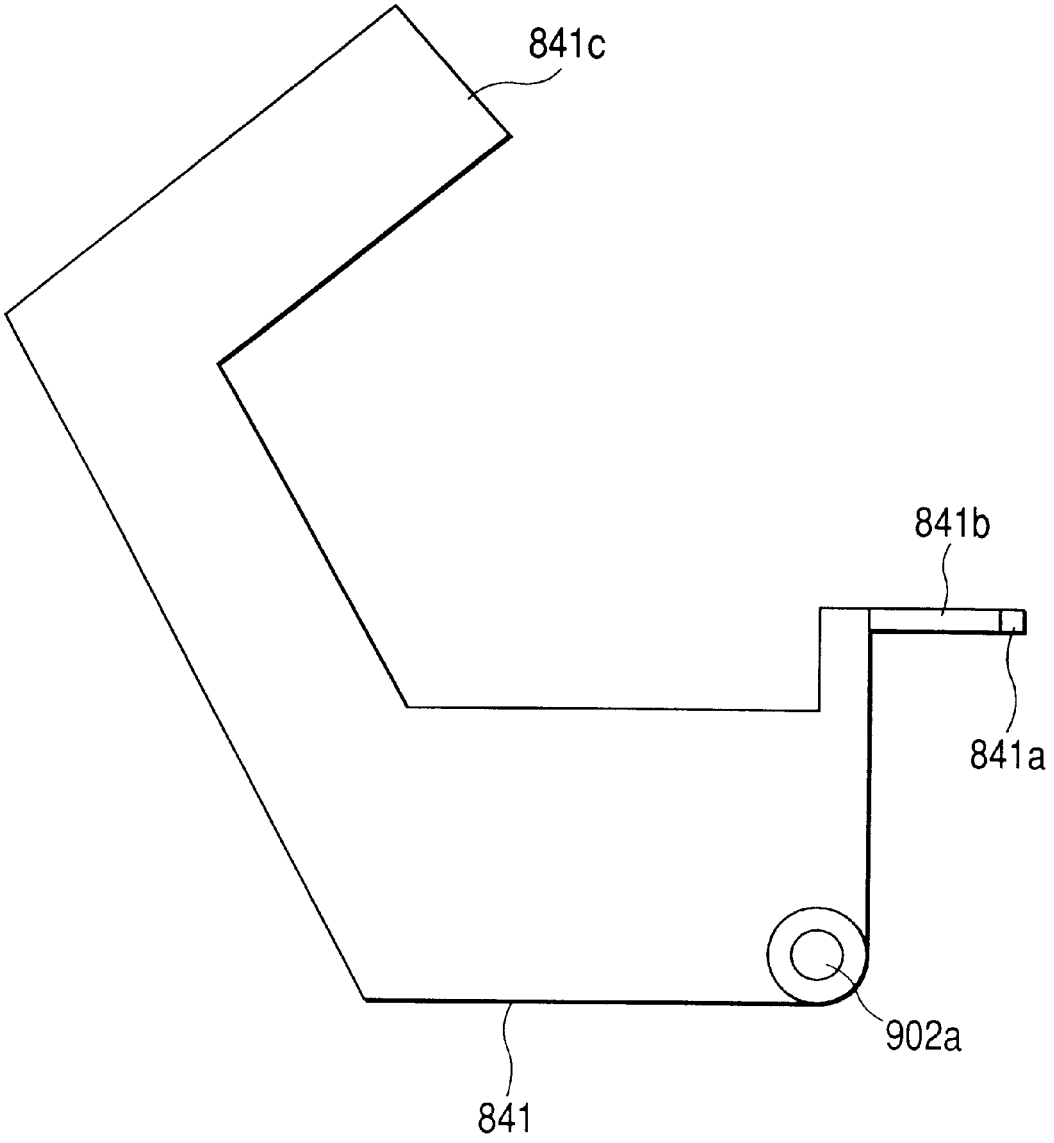
FIG. 9 is a plan view showing alteration of a release lever.
Figure 10:
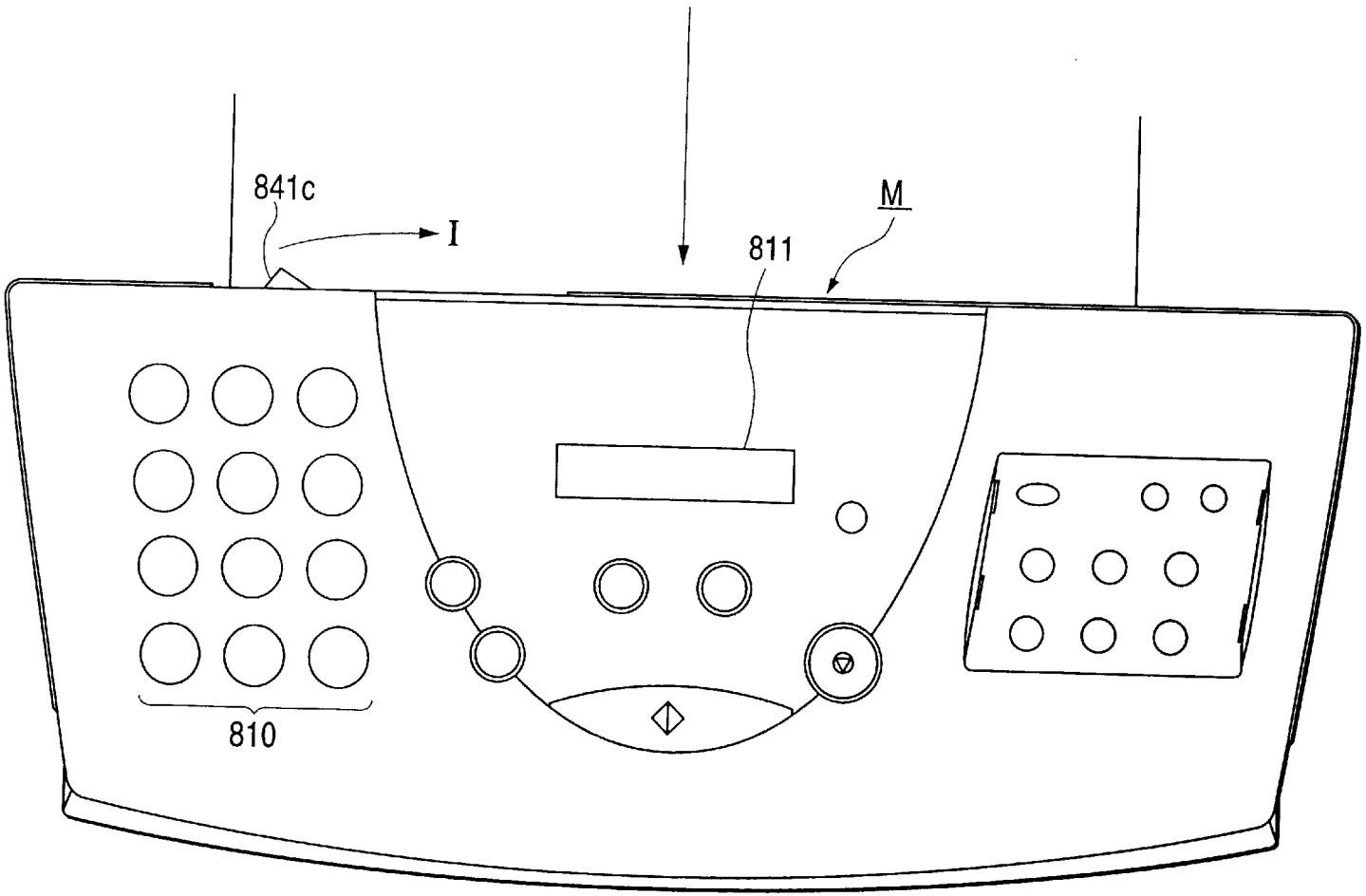
FIG. 10 is a view showing a position of the release lever of FIG. 9 in a condition that a friction means is urged against a sheet convey means, looked at from an operation panel side.
Figure 11:
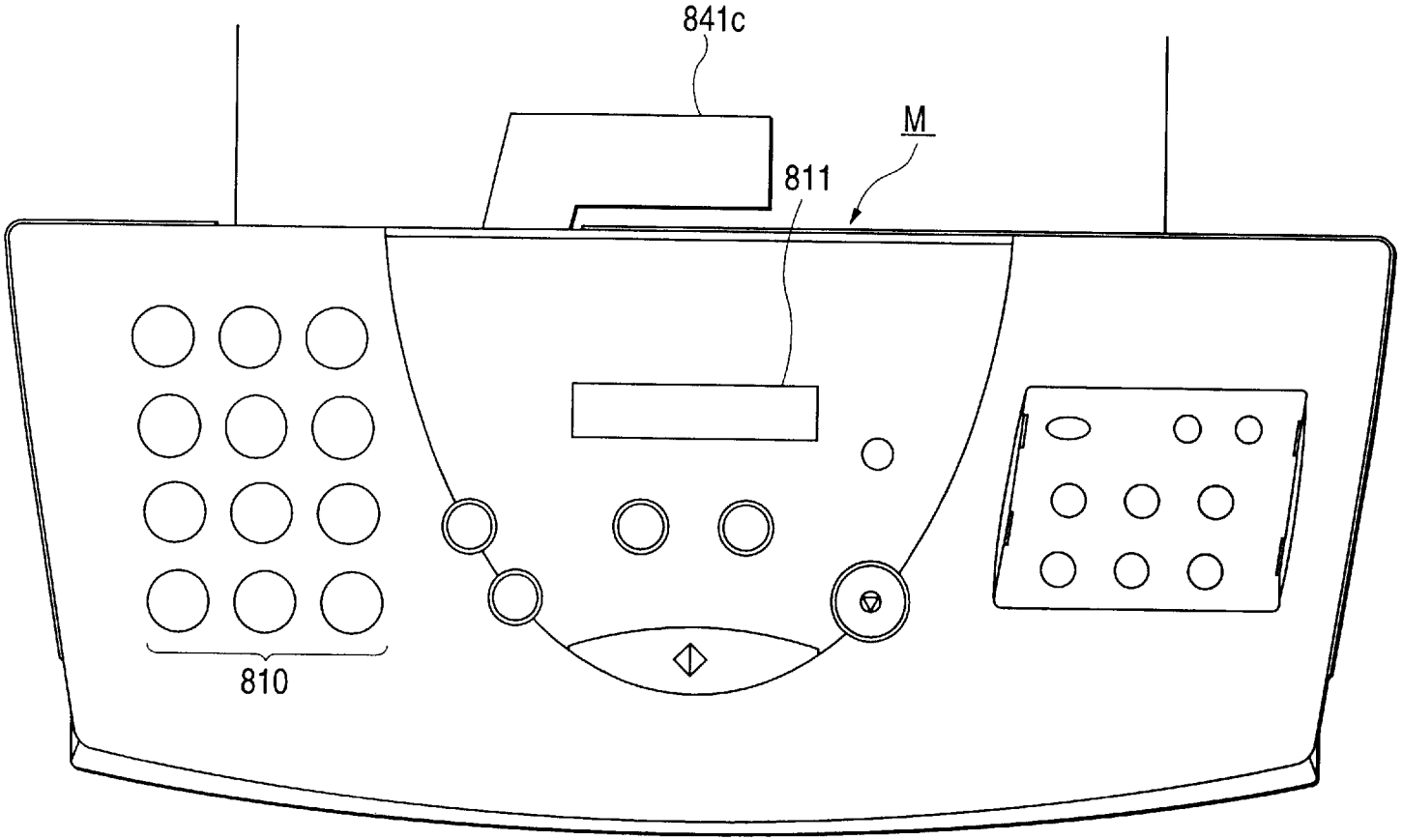
FIG. 11 is a view showing the position of the release lever of FIG. 9 in a condition that the friction means is released, looked at from the operation panel side.

In the release lever 841 shown in FIGS. 7 and 8, although the operation portion 841*c* which is handled by the operator can be formed from a thin member to reduce the material cost, as shown in FIGS. 9 to 11, a width of the operation portion 841*c* of the release lever 841 may be increased and the release lever may be bent at an intermediate portion thereof so that the release of the separation piece 837 can easily be ascertained.

FIG. 10 shows the normal condition that the separation piece 837 is urged against the separation roller 832. In this case, the portion of the operation portion 841*c* of the release lower lever 841 which protrudes out of the apparatus is very small so that the protruded portion can be observed by the operator slightly.

When the separation piece 837 is separated from the separation roller 832 by manipulating the operation portion 841*c* of the release lever 841 in the direction I in FIG. 10 from the condition shown in FIG. 10, the operation portion 841*c* is protruded from the center of the original insertion opening M (refer to FIG. 11).

In this case, when the operator tries to set the plurality of originals G in the condition that the separation piece 837 is separated or released from the separation roller 832, such condition can be ascertained by the operator more easily when the operation portion 841*c* has greater width than when the operation portion 841*c* is formed from the thin member. With this arrangement, even in the condition that the separation piece 837 is more separated or released from the separation roller 832 in comparison with the case where the operation portion 841*c* is formed from the thin member, the erroneous operation in which a plurality of originals G are inserted in the condition that the separation piece 837 is separated or released from the separation roller 832 can be prevented, thereby preventing double-feed of the originals.

Further, when a color of the operation portion 841*c* is selected to differ from colors of the operation panel 800*a* and the original G, the operator can easily ascertain the condition of the separation piece 837. In general, the rear surface of the original G is white or the like. If the operation panel portion 800*a* is white or the like, the color of the operation portion 841*c* may be changed to red, green or dark blue. In this case, when the separation piece 837 is released, the operation portion 841*c* stands out clearly from the original G and the operation panel portion 800*a*, with the result that the operator can easily ascertain the condition of the separation piece 837.

Figure 12:
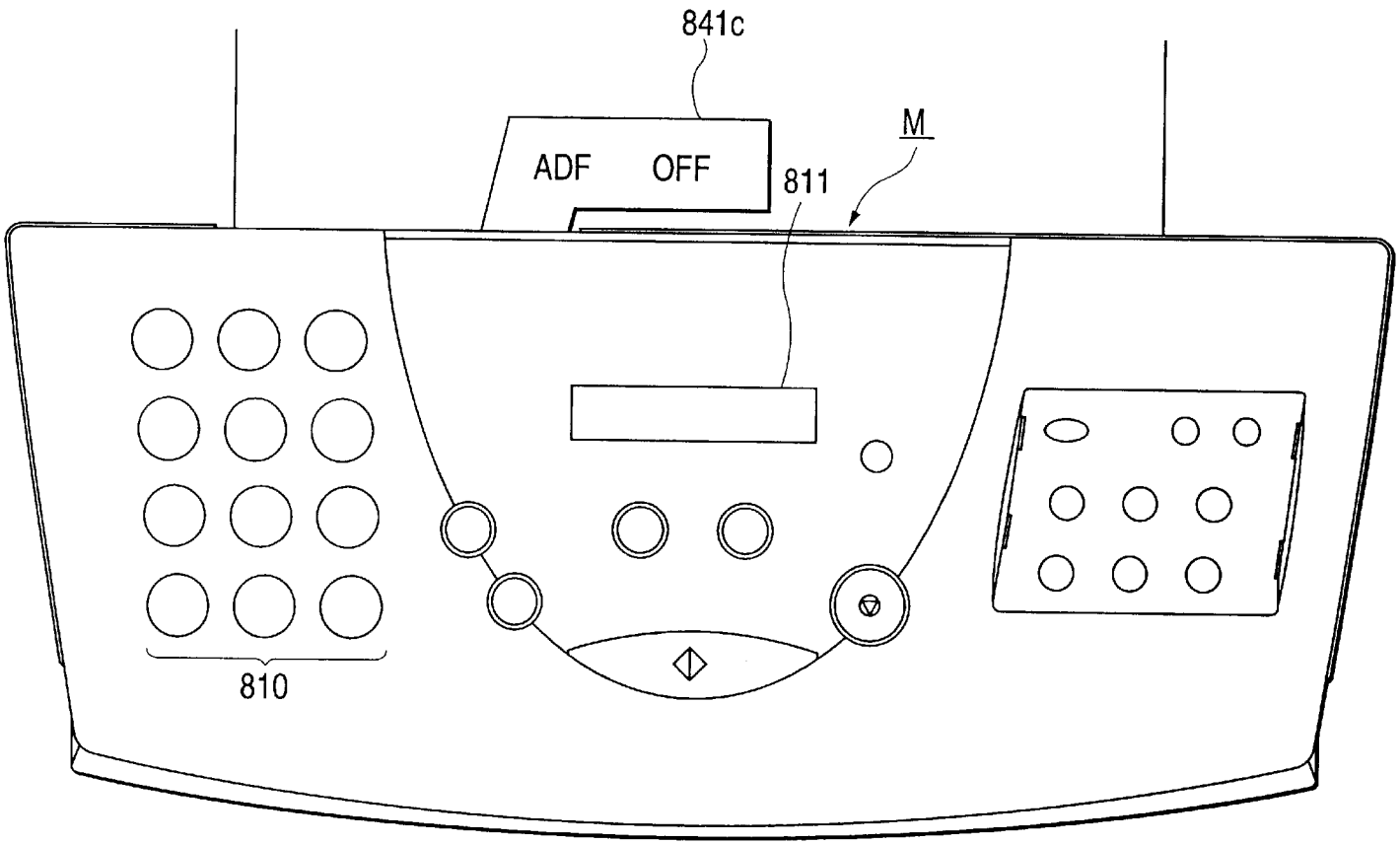
FIG. 12 is a view showing an example that message is printed on a surface of the release lever.

Further, as shown in FIG. 12, in a case where message (for example, "AFD OFF", "A Thick Sheet" or "Sheets cannot be separated") is printed on the operation portion 841*c* of the release lever 841, when the separation piece 837 is released to protrude the operation portion 841*c* out of the operation panel portion 800*a*, the operator can easily ascertain the condition of the separation piece 837.

With the arrangement as mentioned above, since the separation piece 837 can be separated or released from the separation roller 832 by manipulating the operation portion 841*c*, the separation piece 837 can easily be released, and, when the separation piece 837 is released, the single thick sheet or the single original having the imaged rear surface can be conveyed. Further, since the rubber mark of the separation piece 837 is not formed on the rear surface of the original G and the original is not damaged due to the friction between the separation piece 837 and the original, the original D such as the scrap of the newspaper, color page of the magazine, color photograph or visiting card can be conveyed to read the image thereon.

In the condition that the separation piece 837 is released, since the operation portion 841*c* is protruded from the center of the original insertion opening M of the facsimile apparatus, the condition of the separation piece 837 can easily be ascertained from the position or appearance of the operation portion 841*c*.

Next, an embodiment in which a stopper is provided for regulating tip end positions of the originals when the originals are set in the scanner portion will be explained. Incidentally, since other constructions than that associated with the stopper are the same as those in the previous embodiment, detailed explanation thereof will be omitted.

Figures 13A, 13B:
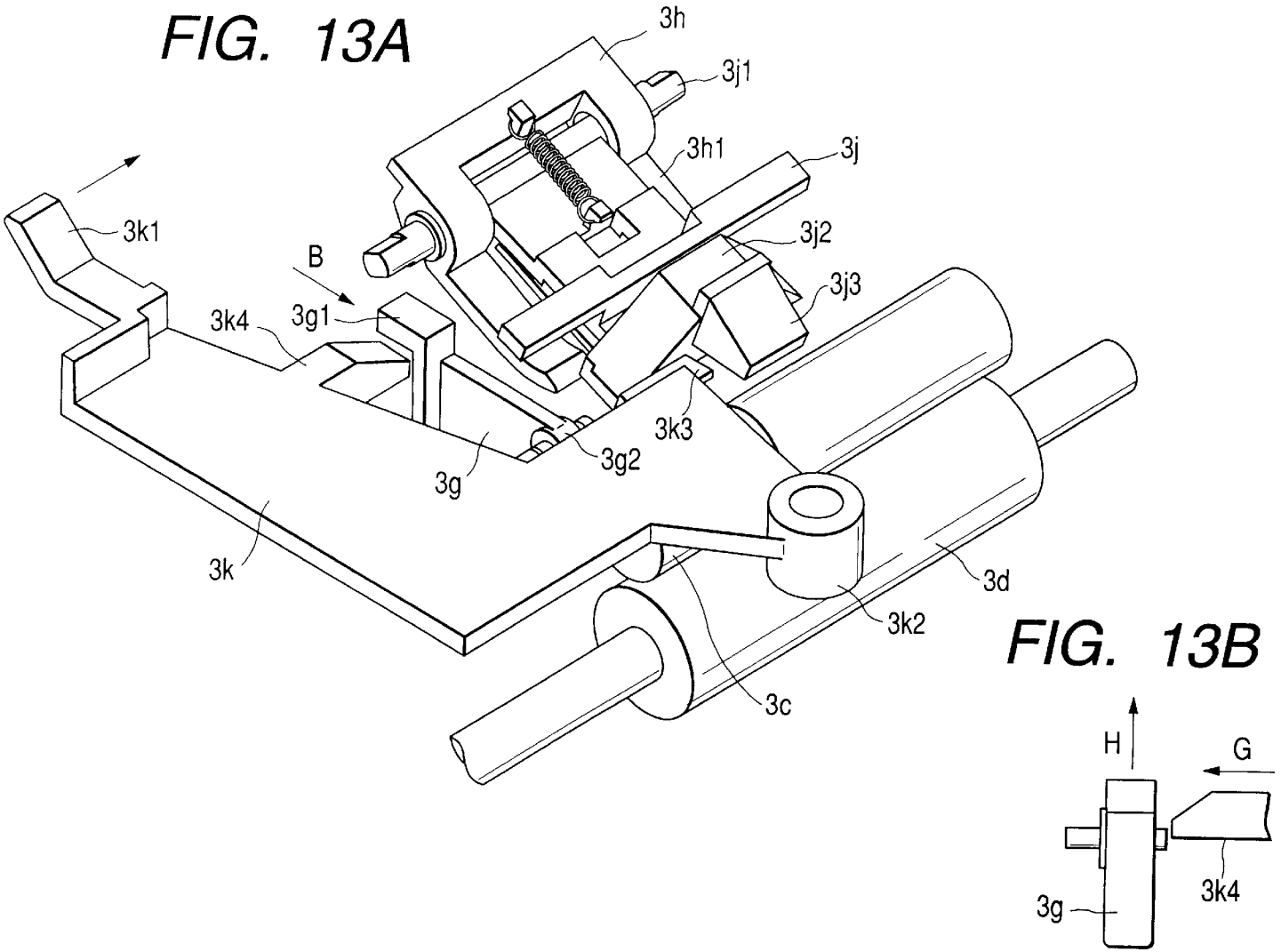
FIGS. 13A and 13B are perspective views of a synchronous releasing mechanism according to the present invention.

In FIGS. 13A and 13B, the reference numeral 3*k* denotes a release lever; 3*g* denotes a stopper; 3*h* denotes a preliminary urging arm; 3*j* denotes a friction piece holder for holding a friction piece 3*b*; 3*c* denotes a sheet supply sub-roller having a release source; and 3*d* denotes a sheet supply roller. When an operation portion 3*k*1 of the release lever 3*k* is shifted in a direction J, the release lever is rotated around a boss 3*k*2 pivotally connected to a body of the apparatus, with the result that the holder is lifted by a first cam 3*k*3 of the release lever 3*k* as will be described later, and a second cam 3*k*4 of the release lever 3*k* is shifted in a direction G in FIG. 13B (view looked at from a direction B in FIG. 13A) to be engaged by an engagement portion 3*g*1 of the stopper 3*g*, with the result that the stopper is lifted in a direction H., The stopper is rotatably supported by the body of the apparatus via a fulcrum 3*g*2 so that the stopper can be shifted an up-and-down direction perpendicular to a sheet conveying direction.

Figure 14A:
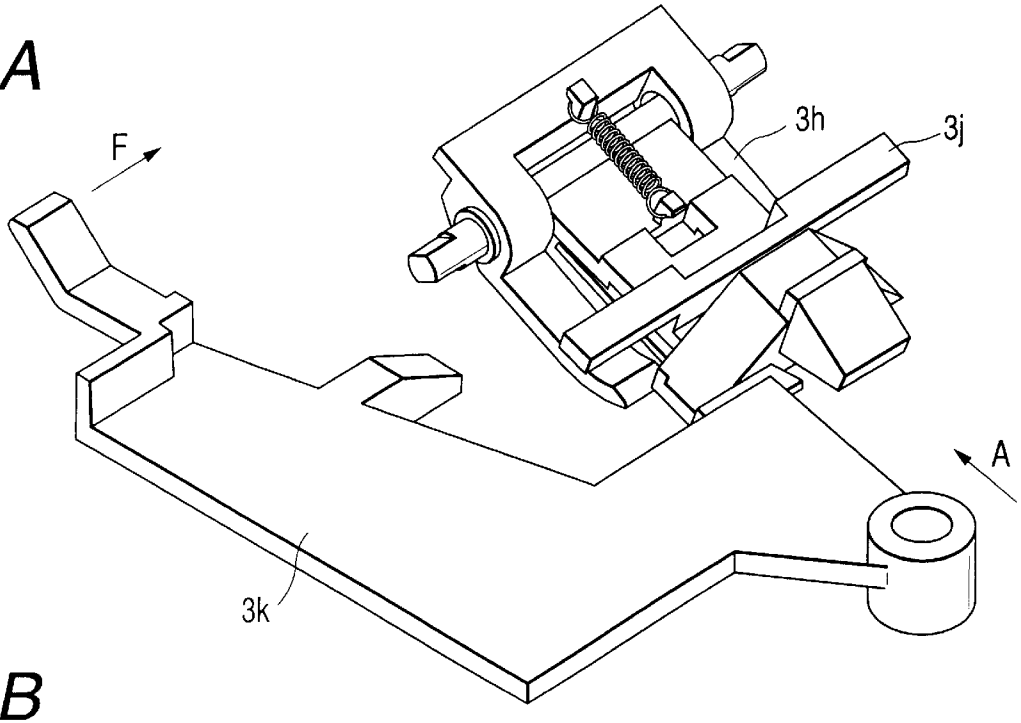
FIGS. 14A and 14B are perspective views of a separation pad pressure releasing mechanism according to the present invention.
Figure 14B:
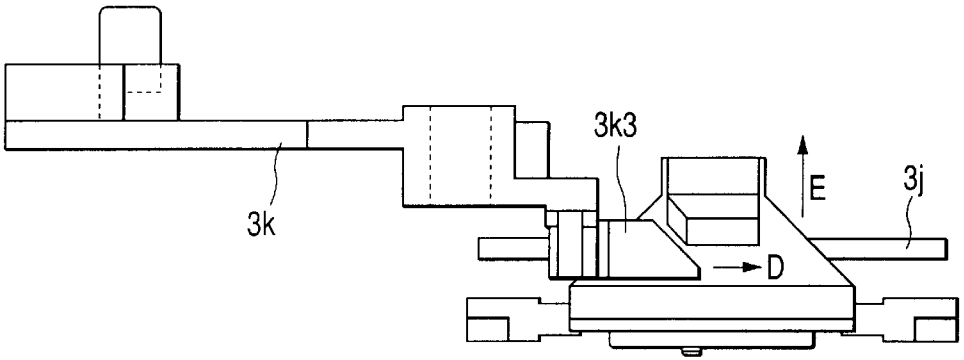

FIGS. 14A and 14B are explanatory views for explaining a separation piece pressure releasing mechanism. As shown in FIGS. 14A and 14B, when the release lever is shifted in a direction K, the first cam 3*k*3 of the release lever 3*k* is shifted in a direction D in FIG. 14B (view looked at from a direction A in FIG. 14A), thereby lifting the holder 3*j* in a direction E. In this case, the separation piece is released, but the preliminary urging arm 3*h* is remained in the urged condition.

As explained in connection with FIGS. 13A and 13B, and 14A and 14B, in synchronous with the releasing of the separation piece pressure, the sheet material regulating stopper 3*g* is released. With this arrangement, when the separation piece pressure is released, the unnecessary stopper 3*g* is released so that the continuous sheet conveyance is permitted.

Now, a separation pressure mechanism will be explained with reference to FIGS. 13A to 15 and 17. The separation pressure mechanism includes the holder 3*j* rotatably supported by the body of the apparatus via a support shaft 3*j*1 and adapted to hold the friction piece (separation piece) 3*b*. The holder 3*j* is provided with a spring receiving portion 3*j*2, and an engagement portion 3*j*3 adapted to be engaged by the first cam 3*k*3 and is biased toward a separation roller (convey roller) 3*a*by engaging an elastic member such as a coil spring 3*j*4 with the spring receiving portion 3*j*2. Further, the preliminary urging arm 3*h* having two arm portions 3*h*1 extending across the holder 3*j* is rotatably supported by the support shaft 3*j*1, and the arm portions 3*h*1 are biased toward the separation roller by an elastic member such as a coil spring 3*h*2. Contact positions between the arm portions and the separation roller are located at an upstream side of a contact position between the friction piece and the separation roller in the sheet conveying direction.

Next, an operation of the stopper will be briefly explained with reference to FIGS. 15 and 16. First of all, in an initial condition, the stopper 3*g* is in a waiting position. When the plurality of originals S are set, tip ends of the originals S abut against a stop surface 3*g*3. Then, when the original conveyance is started by depressing a start button to rotate the sheet supply roller 3*d*, the sheet supply sub-roller 3*c* having the release source is rotatingly driven. The sheet supply sub-roller 3*c* is provided at its one end with a projection 3*c*1 and the stopper 3*g* is provided with a projection 3*g*4. When these projections are engaged by each other, the stopper 3*g* is rotated to shift the stop surface 3*g*3 above the sheet conveying plane, with the result that the sheet convey path is opened, thereby permitting the original to enter into the separation portion. When the sheet supply sub-roller 3*c* is rotated by a predetermined angle, the projection 3*c*1 is disengaged from the projection 3*g*4, with the result that the stopper 3*g* is lowered until it is stopped by a stopper (not shown). When the sheet supply sub-roller 3*c* is further rotated, the stopper 3*g* is reciprocally shifted upwardly and downwardly. While the sheet materials are being conveyed below the stopper, the lowering of the stopper is prevented by the sheet materials. The cooperation mechanism between the sheet supply roller and the sheet supply sub-roller is not limited to the above-mentioned projections, but other structures may be adopted. Then, the sheets passed through the stopper are separated one by one by the friction piece 3*b* and the separation roller 3*a*against which the friction piece is urged. When the last original leaves the stopper 3*g*, the stopper 3*g* which was prevented from lowering by the sheet is lowered, with the result that the stopper can be reciprocally shifted upwardly and downwardly by the rotation of the sheet supply sub-roller.

When the plurality of originals are set, the original stacks are rarely set continuously; whereas, when the single sheet is supplied in the condition that the friction piece is released, since only the single sheet is conveyed, the continuous setting is effected frequently. If the original is set during the reciprocal movement of the stopper 3*g*, the sheet jam may occur. To avoid this, in the present invention, the regulation of the stopper 3*g* is released at the same time when the separation piece is released. With this arrangement, when the single original is set, at the time when the tail end of the original leaves the separation roller, the next original can be set. Thus, usability and quality of the sheet supplying apparatus can be improved remarkably. After the original was read, the motor is rotated reversely and the motor is stopped in the condition that the stopper 3*g* is lowered In this way, the penetration of the original can be prevented with a simple construction.

Figure 15:
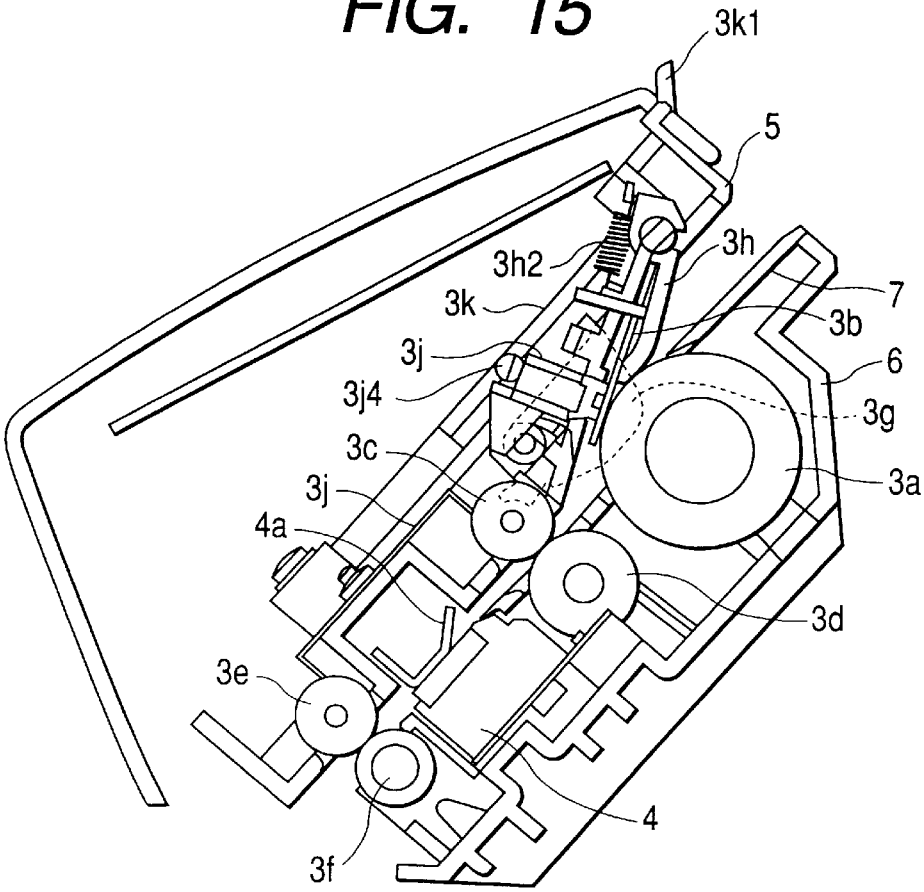
FIG. 15 is a front sectional view of an image forming apparatus according to the present invention.
Figure 16:
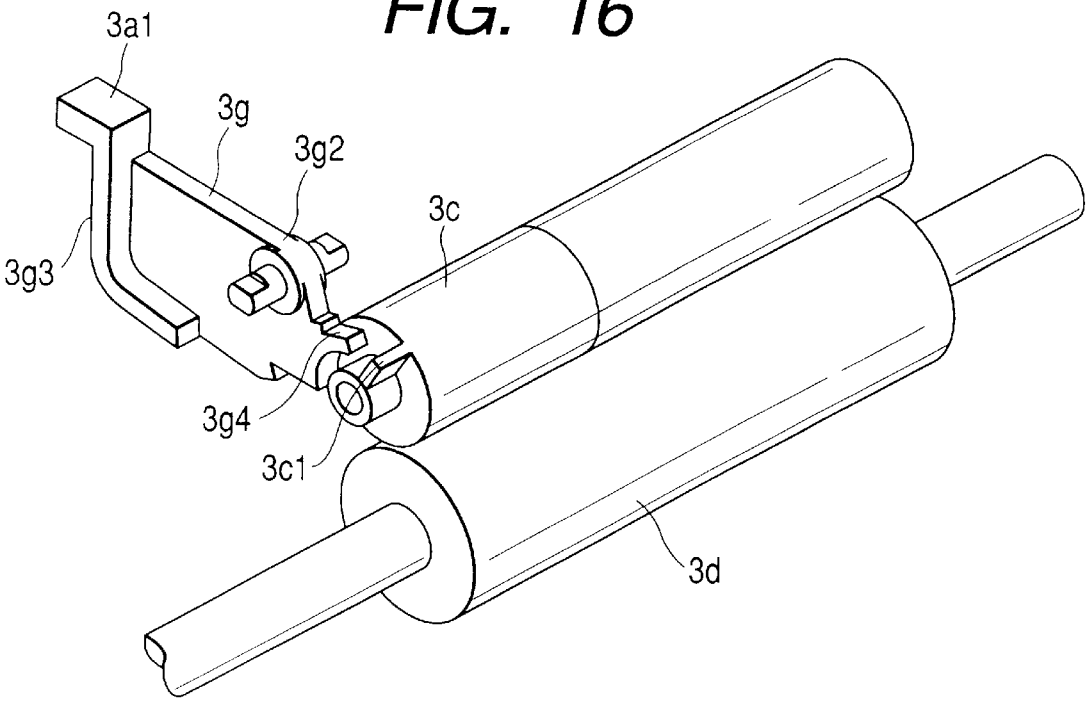
FIG. 16 is a perspective view of a sheet material regulating mechanism according to the present invention.
Figure 17:
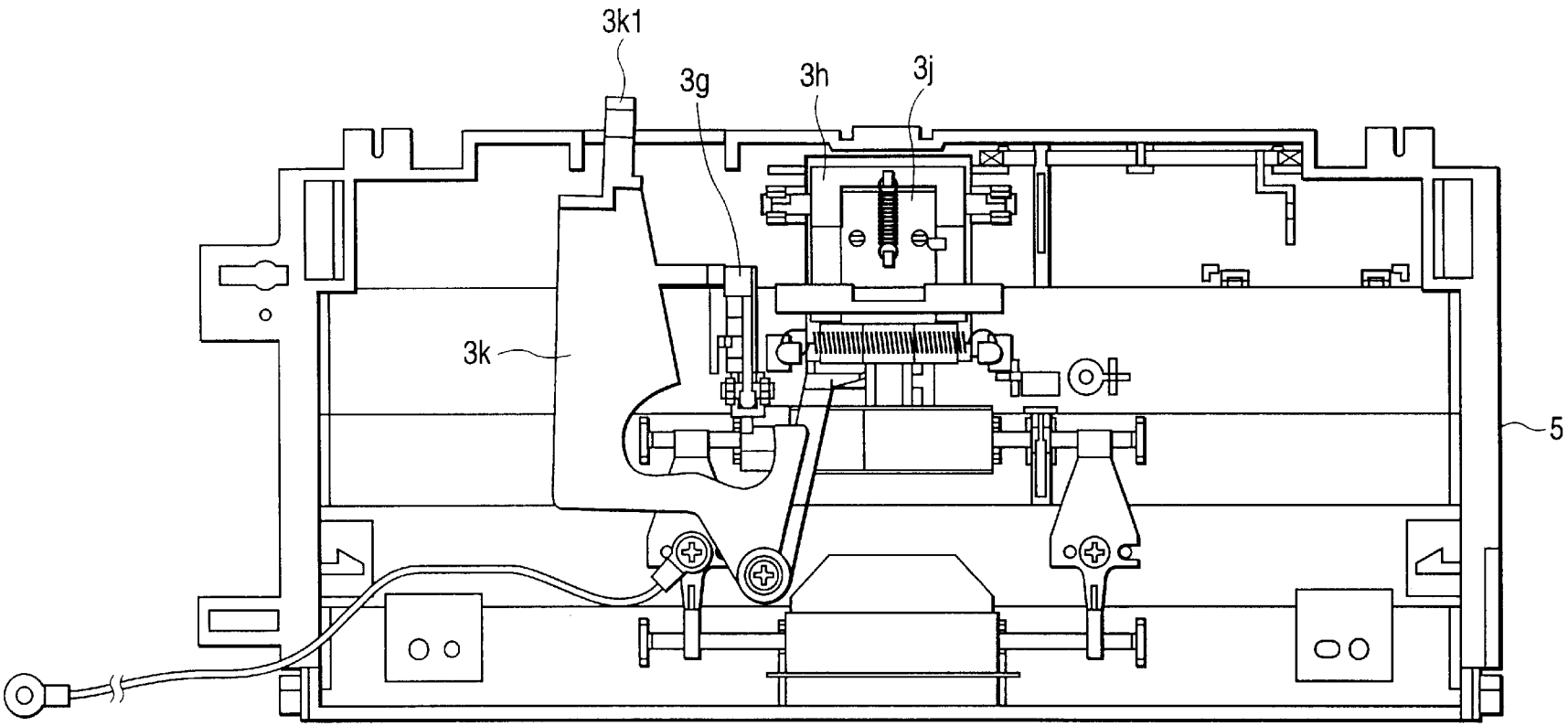
FIG. 17 is a top view of an upper original plate unit according to the present invention.

In summarizing the single original supply, as shown in the original reading automatic sheet supplying apparatus shown in FIG. 15, in the image reading portion 2, before the originals are set, first of all, by shifting the operation portion 3*k*1 of the release lever 3*k*, the single sheet conveyance or the plural sheet conveyance is selected. Then, the originals are set. The originals are pinched between the preliminary urging arm 3*h* and the separation roller 3*a*and abuts against the stop surface of the stopper 3*g* so that the originals cannot further advance.

In case of the single original supply, the stopper 3*g* is released. Then, when the original conveyance is started, the stopper 3*g* is opened by the sheet supply sub-roller 3*c* having the release source, and the originals are sent to the friction piece 3*b* by the preliminary urging arm 3*h* and the separation roller 3*a*against which the preliminary urging arm is urged, where the originals are separated and supplied one by one by the friction piece 3*b* and the separation roller 3*a*against which the friction piece is urged. In case of the single original supply, the original is supplied by the preliminary urging arm 3*h* and the separation roller 3*a*against which the preliminary urging arm is urged, thereby sending the original to the sheet supply roller 3*d*. Then, the original is sent to an image sensor 4 of close contact type by the sheet supply roller 3*d* against which the sheet supply sub-roller 3*c* is urged by the urging spring 3*i* . The original S is urged against the image sensor 4 of close contact type by an original hold-down plate 4*a*. After the image information on the original S is read while line-sending the original contacted with the sensor, the original S is discharged onto an original and recording sheet discharge tray 18 by a discharge roller 3f against which a discharge sub-roller 3*e* is urged by the urging spring 3*i*. Meanwhile, the original S is guided by an upper original guide 5 and a lower original guide In the above-mentioned embodiment, while an example that the facsimile is used as the image forming apparatus and the originals are separated was explained, the present invention can be applied to other image forming apparatuses such as copying machines, printers and the like, and to the separation and conveyance of recording sheets other than the originals.

What is claimed is:

1. A sheet separating and conveying apparatus for separating stacked sheets and for conveying a separated sheet, comprising:

sheet convey means for conveying the sheet by rotation of said sheet convey means;

friction means disposed to oppose to said sheet convey means;

biasing means for contacting said sheet convey means and said friction means against each other;

preliminary convey means adapted to be contacted against said sheet convey means at an upstream side of a contact position between said sheet convey means and said friction means in a sheet conveying direction, wherein said preliminary convey means urge the sheet to said sheet convey means and the sheet is preliminarily conveyed by the rotation of the sheet convey means; and friction releasing means for separating said sheet convey means and said friction means from each other;

wherein, when sheet convey means and said friction means are separated from each other by said friction releasing means, said preliminary convey means is maintained in a condition that said preliminary convey means is contacted against said sheet convey means so as to convey the sheet.

2. A sheet separating and conveying apparatus according to claim 1, wherein said friction releasing means separates said friction means from said sheet convey means against a biasing force of said biasing means.

3. A sheet separating and conveying apparatus according to claim 2, wherein said friction means has a high coefficient of friction, and a rockable holder for holding said friction means, and said biasing means biases said holder to contact said friction means against said sheet convey means, and said friction releasing means is engaged by said holder to separate said friction means from said sheet convey means.

4. A sheet separating and conveying apparatus according to claim 3, wherein said preliminary convey means comprises an arm member rockably supported by said holder, and a preliminary convey spring disposed between said holder and said arm member, wherein said arm member is contacted against said sheet convey means by an elastic force of said preliminary convey spring.

5. A sheet separating and conveying apparatus according to claim 4, wherein said holder has a projection shaft by which said holder is rockably supported on a body of the apparatus, and said arm member has a concave portion which is engaged by said projection shaft to rockably support said arm member.

6. A sheet separating and conveying apparatus according to claim 3, wherein said friction releasing means includes a rotatable release lever having an operation portion exposed out of a body of the apparatus, and said friction means is separated from said sheet convey means by rotating said release lever by manipulating said operation pattern.

7. A sheet separating and conveying apparatus according to claim 6, wherein said release lever has an engagement portion including an inclined portion for engaging with said holder to shift said holder in a direction that said friction means is separated from said sheet convey means, and a flat portion for maintaining said friction means in a condition that said friction means is separated from said sheet convey means.

8. A sheet separating and conveying apparatus according to claim 6, further comprising a sheet insertion opening into which a sheet bundle is inserted toward between said sheet convey means and said friction means, and said operation portion of said release lever is disposed at the side of said sheet insertion opening.

9. A sheet separating and conveying apparatus according to claim 8, wherein, when said friction means is separated from said sheet convey means, said operation portion of said release lever protrudes toward the center of said insertion opening.

10. A sheet separating and conveying apparatus according to claim 9, wherein said operation portion is provided with an index for indicating the condition that said friction means is separated from said sheet convey means, and, when said operation portion protrudes toward the center of said sheet insertion opening, said index can be seen.

11. A sheet separating and conveying apparatus according to claim 9, wherein said release lever is colored with a color different from a color of an outer surface of the body of the apparatus.

12. A sheet separating and conveying apparatus according to claim 9, further comprising a sheet detecting means for detecting the sheet inserted from said sheet insertion opening, wherein said friction means and said sheet convey means are disposed at the center of a width-wise direction of the sheet inserted from said sheet insertion opening, and said release lever and said sheet detecting means are respectively disposed on both sides of said friction means with interposity said friction means therebetween.

13. A sheet separating and conveying apparatus according to claim 12, wherein said sheet detecting means includes a sheet presence detecting means for detecting a presence of the sheet inserted, and a sheet and detecting means for detecting an end of the sheet conveyed.

14. A sheet separating and conveying apparatus according to claim 9, wherein said release lever is disposed in the vicinity of said sheet insertion opening and is shiftable along a plane parallel with a sheet conveying plane for conveying the sheet.

15. A sheet separating and conveying apparatus according to claim 1, further comprising a sheet insertion opening into which a sheet bundle is inserted toward between said sheet convey means and said friction means, and a stopper for regulating a tip end of the sheet inserted from said sheet insertion opening.

16. A sheet separating and conveying apparatus according to claim 15, wherein, when said sheet convey means and said friction means are separated from each other by said friction releasing means, said stopper is escaped from a position where the tip end of the sheet is regulated by said stopper.

17. A sheet separating and conveying apparatus according to claim 16, wherein said friction releasing means comprises a release lever for separating said friction means from said sheet convey means, and said stopper is retarded by manipulating said release lever.

18. A sheet separating and conveying apparatus according to claim 17, wherein said friction means comprises a friction piece having high coefficient of friction, and a holder for supporting said friction piece, and, by manipulating said release lever, said release lever is engaged by said holder to separate said friction piece from said sheet convey means and said release lever is engaged by said stopper to shift said stopper to the escape position.

19. A sheet separating and conveying apparatus according to claim 16, further comprising a sheet supply means disposed at a downstream side of said sheet convey means and adapted to convey the sheet separated one by one by said sheet convey means and said friction means, wherein said stopper is shifted between the regulating position and the escape position in synchronous with rotation of said sheet supply means.

20. A sheet separating and conveying apparatus according to claim 1, wherein said sheet convey means comprises a rotatable roller.

21. An image reading apparatus comprising:

a sheet separating and conveying apparatus according claim 1; and a reading means for reading an image formed on the sheet fed out from said sheet separating and conveying apparatus.

22. An image reading apparatus according to claim 21, wherein a sheet convey path extending from said sheet insertion opening to said reading means is inclined with respect to a horizontal plane by a predetermined angle.

23. An image recording apparatus comprising:

an image reading apparatus according to claim 21; and a recording means for recording an image read by said image reading apparatus onto a sheet.

24. An image recording apparatus comprising:

an image reading apparatus according to claim 22; and a recording means for recording an image read by said image reading apparatus onto a sheet.

* * * * *

UNITED STATES PATENT AND TRADEMARK OFFICE

CERTIFICATE OF CORRECTION

PATENT NO. : 6,152,442
DATED : November 28, 2000
INVENTOR(S) : Takayuki Nishinohara, et al.

It is certified that error appears in the above-identified patent and that said Letters Patent is hereby corrected as shown below:

Column 4:
Line 4, "can" should read -- can be --.
Line 62, "carious" should read -- various --.

Column 5:
Line 21, "to an" should read -- to and --.

Column 6:
Line 25, "a upper" should read -- an upper --.

Column 9:
Line 4, "does" should read -- is --.

Column 11:
Line 52, "message" should read -- a message --.

Column 12:
Line 33, "shifted an" should read-- shifted in an --.
Line 46, "in synchronous" should read -- synchronous Column 13:
Line 63, "In case" should read -- In the case --.

Column 15:
Line 27, "toward" should be deleted.
Line 54, "ity said" should read -- ity of said --.

UNITED STATES PATENT AND TRADEMARK OFFICE

CERTIFICATE OF CORRECTION

PATENT NO. : 6,152,442
DATED : November 28, 2000
INVENTOR(S) : Takayuki Nishinohara, et al.

It is certified that error appears in the above-identified patent and that said Letters Patent is hereby corrected as shown below:

Column 16,
Line 6, "toward" should be deleted.
Line 41, "according" should read -- according to --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*